US008322426B2

(12) United States Patent
Wright et al.

(10) Patent No.: US 8,322,426 B2
(45) Date of Patent: Dec. 4, 2012

(54) DOWNHOLE ACTUATOR APPARATUS HAVING A CHEMICALLY ACTIVATED TRIGGER

(75) Inventors: Adam Wright, McKinney, TX (US); Donald Herbert Perkins, Allen, TX (US); Michael Linley Fripp, Carrollton, TX (US); Scott Luke Miller, Highland Village, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 213 days.

(21) Appl. No.: 12/768,927

(22) Filed: Apr. 28, 2010

(65) Prior Publication Data

US 2011/0265987 A1 Nov. 3, 2011

(51) Int. Cl.
*E21B 34/06* (2006.01)
*E21B 23/04* (2006.01)

(52) U.S. Cl. ..... 166/317; 166/376

(58) Field of Classification Search ..... 166/299, 166/63, 317, 376
See application file for complete search history.

(56) References Cited

U.S. PATENT DOCUMENTS 2,695,065 A * 11/1954 Baker et al. ..... 166/63
4,619,318 A * 10/1986 Terrell et al. ..... 166/55
4,842,062 A * 6/1989 Schneider et al. ..... 166/154
5,558,153 A 9/1996 Holcombe et al.
6,070,672 A * 6/2000 Gazda ..... 166/386
6,340,062 B1 1/2002 Skinner
6,382,234 B1 5/2002 Birckhead et al.
6,554,074 B2 4/2003 Longbottom
RE41,979 E * 12/2010 Latiolais et al. ..... 166/386
2010/0175867 A1 7/2010 Wright
2012/0043092 A1 * 2/2012 Arizmendi et al. ..... 166/369

FOREIGN PATENT DOCUMENTS

WO 2009098498 8/2009

OTHER PUBLICATIONS

International Search Report, PCT (Sep. 30, 2011).

* cited by examiner

*Primary Examiner* — David Andrews
(74) *Attorney, Agent, or Firm* — Lawrence R. Youst

(57) ABSTRACT

A downhole actuator apparatus that selectively maintains a pressure differential between two pressure regions in a well. The apparatus includes a body defining first and second chambers. A piston is slidably disposed in the body and is selectively moveable between first and second positions. A barrier is disposed in the body to selectively separate the first and second chambers. A fluid is disposed in the first chamber between the barrier and the piston. A control system that is at least partially disposed within the body is operable to generate an output signal responsive to receipt of a predetermined input signal. The output signal is operable to create a failure of the barrier such that at least a portion of the fluid flows from the first chamber to the second chamber and the piston moves from the first position to the second position.

20 Claims, 5 Drawing Sheets

DOWNHOLE ACTUATOR APPARATUS HAVING A CHEMICALLY ACTIVATED TRIGGER

FIELD OF THE INVENTION

This invention relates, in general, to equipment utilized in conjunction with operations performed in subterranean wells and, in particular, to a downhole actuator apparatus having a chemically activated trigger.

BACKGROUND OF THE INVENTION

Without limiting the scope of the present invention, its background will be described in relation to setting packer assemblies, as an example.

In the course of completing a subterranean well, one or more packer assemblies are commonly installed at various locations within the well to isolate the wellbore annulus from the production tubing. Typically, a packer assembly incorporates a slip arrangement for securing the packer against the casing or liner wall and an expandable elastomeric element for creating a reliable hydraulic seal to isolate the annulus. In this manner, the packer assemblies are capable of supporting the production tubing and other completion equipment in the well and providing a seal between the outside of the production tubing and the inside of the well casing to block movement of fluids in the annulus to, for example, isolate a production interval.

Such production packers as well as other types of downhole tools may be run downhole on production tubing to a desired depth in the wellbore. Certain production packers may be set hydraulically by creating a pressure differential across a setting piston. For example, this pressure differential may be generated by creating a pressure differential between the fluid within the production tubing and the fluid within the wellbore annulus. This pressure differential shifts the setting piston to actuate the production packer into sealing and gripping engagement with the wellbore casing or liner. To prevent premature actuation of the setting piston, an actuator assembly including a rupture disc may be positioned in the flow path between the pressure differential. When it is desired to set the production packer, sufficient pressure may be applied to burst the rupture disc, thereby allowing the actuator assembly to operate and providing a fluid path for the differential pressure to operate on the setting piston.

As operators increasingly pursue more complicated completions in deep water offshore wells, highly deviated wells and extended reach wells, the use of rupture discs to create a downhole pressure barrier has become more difficult due to the lack of pressure headroom between the downhole hydrostatic pressure and the burst or collapse pressure of the downhole tubulars. Accordingly, a need has arisen for a downhole actuator assembly operable to selectively prevent and allow the application of a pressure differential to a hydraulically set downhole tool. A need has also arisen for such a downhole actuator assembly that is operable for use in complicated completions in deep water offshore wells, highly deviated wells and extended reach wells.

SUMMARY OF THE INVENTION

The present invention disclosed herein is directed to an improved downhole actuator assembly operable to selectively prevent and allow the application of a pressure differential to a hydraulically set downhole tool. In addition, the downhole actuator assembly of the present invention is operable for use in complicated completions in deep water offshore wells, highly deviated wells and extended reach wells.

In one aspect, the present invention is directed to a downhole actuator apparatus that has a body defining first and second chambers and a piston slidably disposed in the body that is selectively moveable between first and second positions. A barrier is disposed in the body to selectively separate the first and second chambers. A fluid is disposed in the first chamber between the barrier and the piston. A control system that is at least partially disposed within the body is operable to generate an output signal responsive to receipt of a predetermined input signal. The output signal is operable to create a failure of the barrier such that at least a portion of the fluid flows from the first chamber to the second chamber and the piston moves from the first position to the second position.

In one embodiment, the body defines a fluid path between two pressure regions and the piston is sealably disposed in the fluid path to maintain a pressure differential between the two pressure regions when the piston is in the first position. In this embodiment, the piston may include a piston area that is exposed to pressure from at least one of the pressure regions to bias the piston from the first to the second position. Alternatively or additionally, the piston may be biased toward the second position from the first position by a spring. In another embodiment, the fluid in the first chamber prevents the piston from moving to the second position until failure of the barrier. In this embodiment, fluid may be one or more substantially incompressible fluids, one or more compressible fluids or may be a combination of one or more substantially incompressible fluids and one or more compressible fluids.

In one embodiment, the barrier may be a disc member. In another embodiment, the control system may include a signal detector, a control circuit and a trigger, such that upon receipt of the predetermined input signal by the signal detector, the control circuit activates the trigger to create the failure of the barrier. In this embodiment, the predetermined input signal may be a surface generated signal such as a wireless signal, an electromagnetic signal, an acoustic signal, a pressure signal, an electrical signal, an optical signal or the like. Alternatively, the predetermined input signal may be a downhole generated signal such as a signal from a timer, a downhole sensor or the like. Also, in this embodiment, the output signal may be heat generated by the trigger that melts at least a portion of the barrier, pressure generated by the trigger that shifts a piercing assembly that forms an opening through the barrier, a chemical jet generated by the trigger that makes an opening in the barrier or the like. In this and other embodiments, the trigger may include an energetic material such as pyrotechnic compositions, flammable solids, explosives, thermites and the like.

In another aspect, the present invention is directed to a downhole actuator apparatus that has a body defining first and second chambers and a fluid path between two pressure regions. A piston is slidably disposed in the body and selectively moveable between first and second positions. The piston is sealably disposed in the fluid path to maintain a pressure differential between the two pressure regions when the piston is in the first position. A barrier is disposed in the body to selectively separate the first and second chambers. A fluid is disposed in the first chamber between the barrier and the piston. The fluid is operable to selectively prevent the piston from moving to the second position. A control system is disposed at least partially within the body. The control system includes a signal detector, a control circuit and a thermite trigger, such that upon receipt of a predetermined input signal by the signal detector, the control circuit activates the thermite trigger to create a failure of the barrier enabling at least a portion of the fluid to flow from the first chamber to the second chamber and the piston to move from the first position to the second position, thereby allowing fluid communication between the two pressure regions.

In a further aspect, the present invention is directed to a downhole actuator apparatus that includes a body defining a fluid path between two pressure regions. A barrier is disposed in the fluid path to maintain a pressure differential between the two pressure regions. A control system is at least partially disposed within the body. The control system includes a signal detector, a control circuit and a thermite trigger, wherein upon receipt of a predetermined input signal by the signal detector, the control circuit activates the thermite trigger to create a failure of the barrier, thereby allowing fluid communication between the two pressure regions.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the invention.

Figure 1:
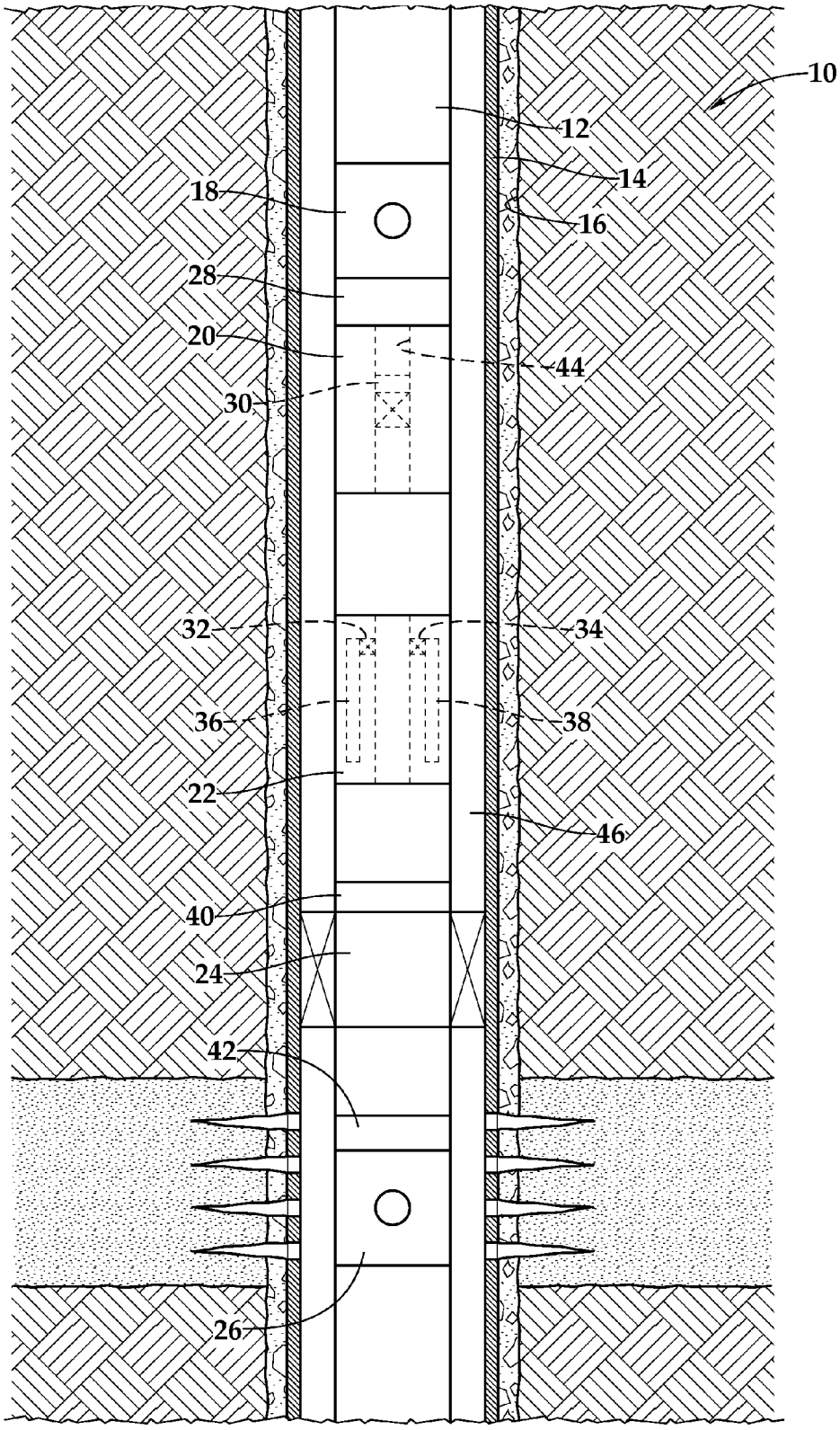
FIG. 1 is a schematic illustration of a well system including a plurality of actuators used to operate well tools by controlling fluid communication between pressure regions in the well according to an embodiment of the present invention.

Referring initially to FIG. 1, a well system that is schematically illustrated and generally designated 10, includes a plurality of well tools that are interconnected to form a tubular string 12 that has been installed in casing string 14 that is cemented in a wellbore 16. Each of the illustrated well tools includes an actuator for operating that well tools between its operating positions or configurations. Specifically, the illustrated well tools are depicted as a circulating valve 18, a tester valve 20, a multi-sampler tool 22, a packer 24 and a choke 26. As depicted, actuator 28 is used to operate circulating valve 18, actuator 30 is used to operate tester valve 20, actuators 32, 34 are used to control flow into sample chambers 36, 38 of a multi-sampler tool 22, actuator 40 is used to set packer 24 and actuator 42 is used to operate choke 26.

In each of these cases, the actuators are used to operate the corresponding well tool by controlling fluid communication between pressure regions in the well. For example, when the pressure regions are blocked from one another, the well tool is in one position and when there is fluid communication between the pressure regions, the well tool is actuated to another position. The pressure regions could be, for example, an interior flow passage 44 of tubular string 12 and an annulus 46 formed radially between tubular string 12 and casing 14. In another example, the pressure regions could be interior flow passage 44 of tubular string 12 and an interior chamber within a sample chamber 36, 38 or the pressure regions could be two chambers with a sample chamber 36, 38 such as a nitrogen charged chamber and an atmospheric chamber. As a further example, the pressure regions could be sections of a control line leading from the surface to a well tool, sections of a control line between well tools or other similar control line configuration. Accordingly, it is to be understood by those skilled in the art that the actuators of the present invention may be used to operate the corresponding well tools by controlling fluid communication between any two pressure regions in the well without departing from the principles of the present invention.

Even though FIG. 1 depicts the actuators of the present invention in a specific well system, it should be understood by those skilled in the art that the actuators of the present invention are equally well suited for use with a wide variety of well tools in other types of well systems. Also, even though FIG. 1 depicts the actuators of the present invention in a vertical section of a wellbore, it should be understood by those skilled in the art that the actuators of the present invention are equally well suited for use in wells having other configurations including slanted wells, deviated wells, horizontal well or wells having lateral branches. Accordingly, it should be understood by those skilled in the art that the use of directional terms such as above, below, upper, lower, upward, downward, left, right and the like are used in relation to the illustrative embodiments as they are depicted in the figures, the upward direction being toward the top of the corresponding figure and the downward direction being toward the bottom of the corresponding figure.

Figure 2A:
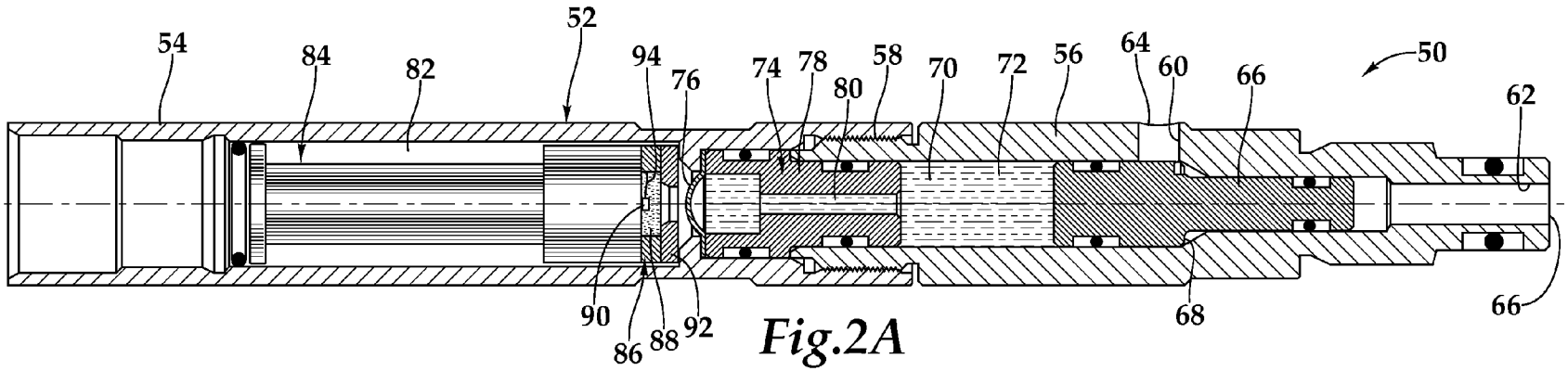
FIGS. 2A-2B are cross sectional views of a downhole actuator apparatus for controlling fluid communication between pressure regions in the well in first and second operating positions according to an embodiment of the present invention.
Figure 2B:
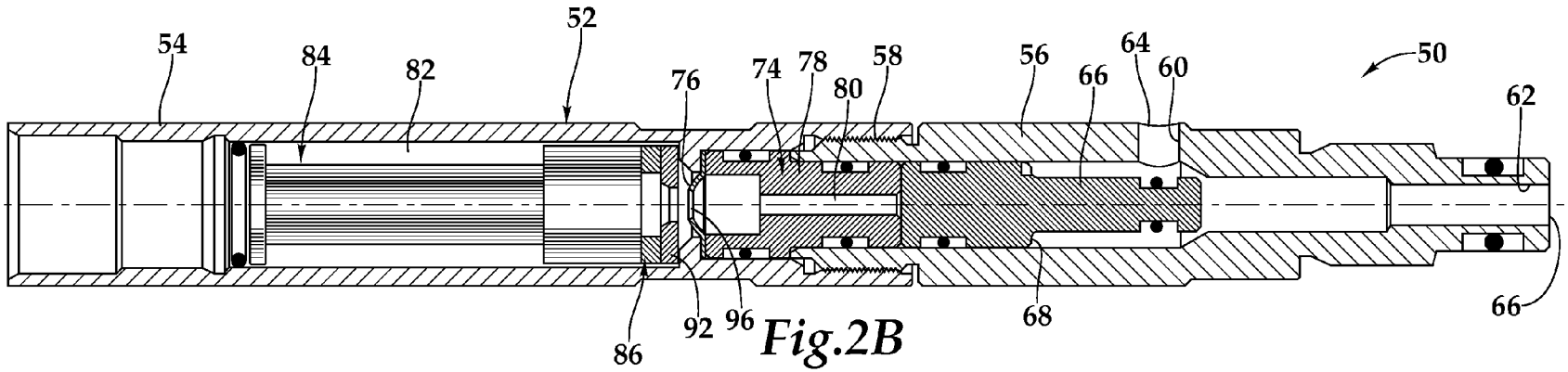

Referring now to FIGS. 2A-2B, a downhole actuator apparatus for controlling fluid communication between pressure regions in the well is depicted in first and second operating positions and is generally designated 50. It should be noted that actuator 50, as well as the other actuator embodiments described below, may operate as any of the actuators described above with reference to FIG. 1 or may operate as a component part or subassembly of such an actuator assembly, for example, to pilot another component of the actuator assembly or associated well tool. In the illustrated embodiment, actuator 50 has an axially extending generally tubular body or housing assembly 52. In the illustrated embodiment, housing assembly 52 includes two housing members 54, 56 that are securably coupled together at a threaded coupling 58. Housing member 56 includes a port 60 and a port 62 that are respectively in communication with different pressure regions in the well. For example, port 60 may be associated with a relatively high pressure region 64, such as the wellbore annulus, a pressurized gas chamber, the central flow path of a tubular string or the like. Likewise, port 62 may be associated with a relatively low pressure region 66, such as an atmospheric chamber, a sample chamber or the like.

Slidably and sealingly disposed within housing member 56 is a piston 66 that initially blocks communication between ports 60, 62, as best seen in FIG. 2A. Piston 66 is biased to the left by pressure acting on a differential piston area 68. Initially, displacement of piston 66 to the left is substantially prevented a fluid 70 disposed within a fluid chamber 72. Fluid 70 is preferably a substantially incompressible fluid such as a hydraulic fluid but could alternatively be a compressible fluid such as nitrogen, a combination of substantially incompressible fluids, a combination of compressible fluids or a combination of one or more compressible fluids with one or more substantially incompressible fluids. Preferably, while fluid 70 prevents piston 66 from moving sufficiently to the left to open communication between ports 60, 62, piston 66 is able to float as pressure differences between pressure region 64 and fluid chamber 72 are balanced.

Securably and sealingly positioned between housing member 54 and housing member 56 is a barrier assembly 74 that includes a barrier 76 and a support assembly 78 having a fluid passageway 80 defined therethrough. Barrier 76 initially prevents fluid 70 from escaping from chamber 72 into a chamber 82 of housing member 54. Barrier 76 is depicted as a disk member and is preferably formed from a metal but could alternatively be made from a plastic, a composite, a glass, a ceramic, a mixture of these materials, or other material suitable for initially containing fluid 70 in chamber 72 but failing in response to an output signal as described below.

Positioned within housing member 54 is a control system 84 that includes numerous components that cooperate together to receive and process a predetermined input signal and to generate an output signal that creates a failure of barrier 76. For example, control system 84 includes a signal detector such as a pressure sensor, a strain sensor, a hydrophone, an antenna or any other type of signal detector which is capable of receiving the predetermined input signal, which may be in the form of a wireless signal such as an acoustic signal, pressure pulses, electromagnetic telemetry or the like. Alternatively, the signal detector could be hard wired to the surface and operable to receive the predetermined input signal in the form of an electrical signal, an optical signal or the like. As another alternatively, the signal detector may communicate with other downhole devices which may be internal or external to housing assembly 52 such as a timer, a downhole sensor or the like that generates the predetermined input signal.

The signal detector may include or be in communication with a control circuit that interprets the input signal, for example, by digitally decoding the input signal, and that determines whether actuator 50 should be operated. The control circuit is preferably an electronic circuit including various components such as a microprocessor, a digital signal processor, random access member, read only member and the like that are programmed or otherwise operable to recognize the predetermined input signal and to determine whether actuator 50 should be operated. Control system 84 also includes a downhole power supply operable to provide the required power to the other elements of control system 84. Preferably, the power supply is in the form of one or more batteries, however, other types of power supplies may alternatively be used without departing from the principles of the present invention. Control system 84 may also include timing devices to delay or control the time period between receipt of the predetermined input signal and the generation of the output signal.

Control system 84 further includes an output signal generator or trigger depicted in FIG. 2A as a chemical jet nozzle assembly 86. Chemical jet nozzle assembly 86 includes a chemical element or energetic material 88, an ignition agent 90 and a nozzle 92. Chemical element 88 is preferably formed from a composition of a metal powder and a metal oxide that produces an exothermic chemical reaction at high temperature known as a thermite reaction. The metal powder used in the composition may include aluminum, magnesium, calcium, titanium, zinc, silicon, boron and the like. The metal oxide used in the composition may include boron(III) oxide, silicon(IV) oxide, chromium(III) oxide, manganese(IV) oxide, iron(III) oxide, iron(II, III) oxide, copper(II) oxide, lead(II, III, IV) oxide and the like. For example, a composition of aluminum and iron(III) oxide may be used which has a reaction according to the following equation:

$$Fe_2O_3+2Al \rightarrow 2Fe+Al_2O_3+Heat$$

Use of chemical element 88 that produces a thermite reaction is advantageous in the present invention as the reactants are stable at wellbore temperatures but produce an extremely intense exothermic reaction following ignition. Chemical element 88 may also include a binder material to hold the included chemicals together, including, for example, TEFLON™, VITON™, PBAN (polybutadiene acrylonitrile copolymer), HTPB (hydroxyl-terminated polybutadiene), epoxy and the like.

In the illustrated embodiment, ignition agent 90 is connected to the control circuit via an electrical cable 94 so that, when it is determined that actuator 50 should be operated, the control circuit supplies electrical current to ignition agent 90. Ignition agent 90 is preferably a metal burning fuse such as a magnesium fuse which is activated by the electrical current. Metal fuses are preferred as metals burn without releasing cooling gases and can burn at extremely high temperatures. Magnesium fuses are most preferred due to the reactive nature of magnesium and the temperature at which magnesium burns which is sufficiently high to ignite chemical element 88. Alternatively, a nichrome wire such as a NiCr60 wire, may be used to directly ignite chemical element 88. As another alternative, a nichrome wire may be used in an ignition train to ignite a metal burning fuse which in turn ignites chemical element 88. In this case, both the nichrome wire and the metal burning fuse may be considered to be ignition agent 90.

In the illustrated embodiment, nozzle 92 is designed to focus the heat and molten materials created in the thermite reaction into a hot jet that is directed towards barrier 76. The hot jet causes a focused hot spot on barrier 76 resulting in the desired failure of barrier 76. It is noted that the mode of failure of barrier 76 may including penetrating, melting, combustion, ignition, weakening or other degradation of barrier 76.

Even though control system 84 has been described as being positioned within housing member 54, those skilled in the art will recognize that certain elements of control system 84 could alternatively be positioned outside of actuator 50 including the signal detector, the control circuit and the power supply, without departing from the principle of the present invention. For example, one or more of these components could be located within the well tool that is to be actuated by actuator 50 or could be located in other tools that are coupled to actuator 50. For the purposes of the present invention, it is only relevant that the output signal generator is positioned sufficiently proximate to barrier 76 to cause the desired failure.

In operation, the signal detector of control system 84 receives the predetermined input signal and the control circuit processes the predetermined input signal to verify the signal. If the control circuit determines that actuator 50 should be operated, electrical power is supplied from the power supply to ignition agent 90 to initiate the chemical reaction in chemical element 88. The chemical reaction causes barrier 76 to fail, creating opening 96 therethrough, as best seen in FIG. 2B. Fluid communication is thus established between chamber 72 and chamber 82 through opening 96, which allows fluid 70 to exit chamber 72 as piston 66 is urged to the left by pressure from high pressure region 64 acting on differential piston area 68. Communication is now permitted between pressure regions 64, 66 via ports 60, 62, as best seen in FIG. 2B.

Figure 3A:
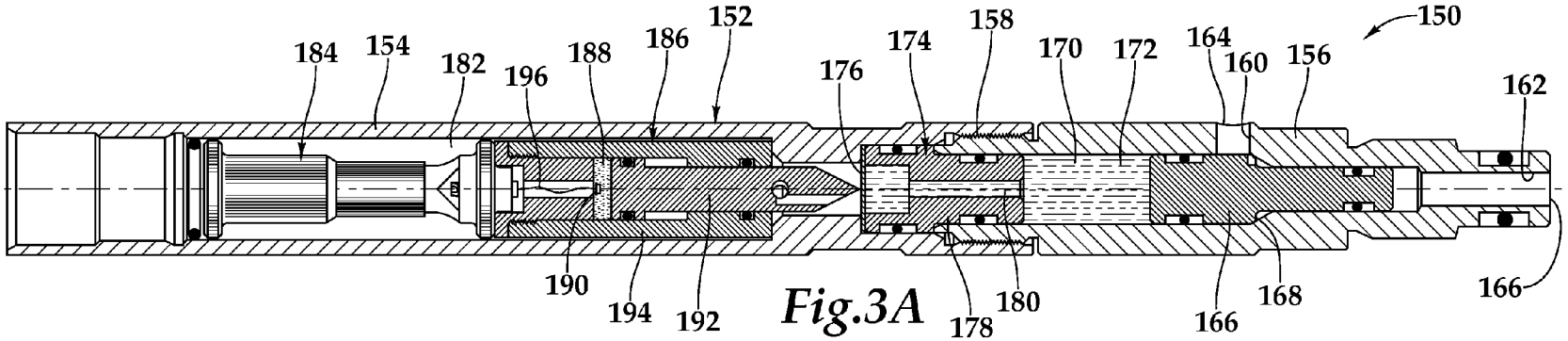
FIGS. 3A-3B are cross sectional views of a downhole actuator apparatus for controlling fluid communication between pressure regions in the well in first and second operating positions according to an embodiment of the present invention.
Figure 3B:
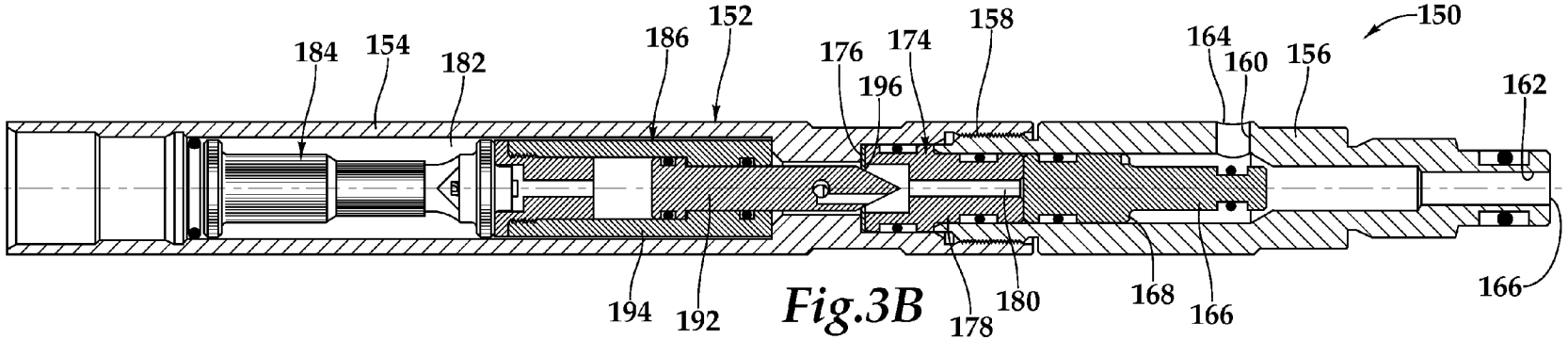

Referring now to FIGS. 3A-3B, a downhole actuator apparatus for controlling fluid communication between pressure regions in the well is depicted in first and second operating positions and is generally designated 150. Actuator 150 has an axially extending generally tubular body or housing assembly 152 including two housing members 154, 156 that are securably coupled together at a threaded coupling 158. Housing member 156 includes ports 160, 162 that are respectively in communication with different pressure regions 164, 166. Slidably and sealingly disposed within housing member 156 is a piston 166 that initially blocks communication between ports 160, 162, as best seen in FIG. 3A. Piston 166 is biased to the left by pressure acting on a differential piston area 168. Initially, displacement of piston 166 to the left is substantially prevented a fluid 170 disposed within a fluid chamber 172. Preferably, while fluid 170 prevents piston 166 from moving sufficiently to the left to open communication between ports 160, 162, piston 166 is able to float as pressure differences between pressure region 164 and fluid chamber 172 are balanced.

Securably and sealingly positioned between housing member 154 and housing member 156 is a barrier assembly 174 that includes a barrier 176 and a support assembly 178 having a fluid passageway 180 defined therethrough. Barrier 176 initially prevents fluid 170 from escaping from chamber 172 into a chamber 182 of housing member 154. Positioned within housing member 154 is a control system 184 that includes a signal detector, a control circuit, a power supply, optional timing devices and an output signal generator or trigger depicted in FIG. 3A as a chemically initiated piercing assembly 186. Chemically initiated piercing assembly 186 includes a chemical element or energetic material 188, an ignition agent 190 and a piercing element 192 slidably disposed within a cylinder 194. Chemical element 188 is preferably a combustible element such as a propellant that has the capacity for extremely rapid but controlled combustion that produces a combustion event including the production of a large volume of gas at high temperature and pressure.

In an exemplary embodiment, chemical element 188 may comprises a solid propellant such as nitrocellulose plasticized with nitroglycerin or various phthalates and inorganic salts suspended in a plastic or synthetic rubber and containing a finely divided metal. Chemical element 188 may comprise inorganic oxidizers such as ammonium and potassium nitrates and perchlorates such as potassium perchlorate. It should be appreciated, however, that substances other than propellants may be utilized without departing from the principles of the present invention, including other explosives, pyrotechnics, flammable solids or the like. In the illustrated embodiment, ignition agent 190 is connected to the control circuit via an electrical cable 196 so that, when it is determined that actuator 150 should be operated, the control circuit supplies electrical current to ignition agent 190.

In operation, the signal detector of control system 184 receives the predetermined input signal and the control circuit processes the predetermined input signal to verify the signal. If the control circuit determines that actuator 150 should be operated, electrical power is supplied from the power supply to ignition agent 190 to initiate the chemical reaction in chemical element 188. The chemical reaction causes piercing element 192 to move to the right piecing barrier 176, as best seen in FIG. 3B. Fluid communication is thus established between chamber 172 and chamber 182 through opening 196, which allows fluid 170 to exit chamber 172 as piston 166 is urged to the left by pressure from high pressure region 164 acting on differential piston area 168. Communication is now permitted between pressure regions 164, 166 via ports 160, 162, as best seen in FIG. 3B.

Figure 4A:
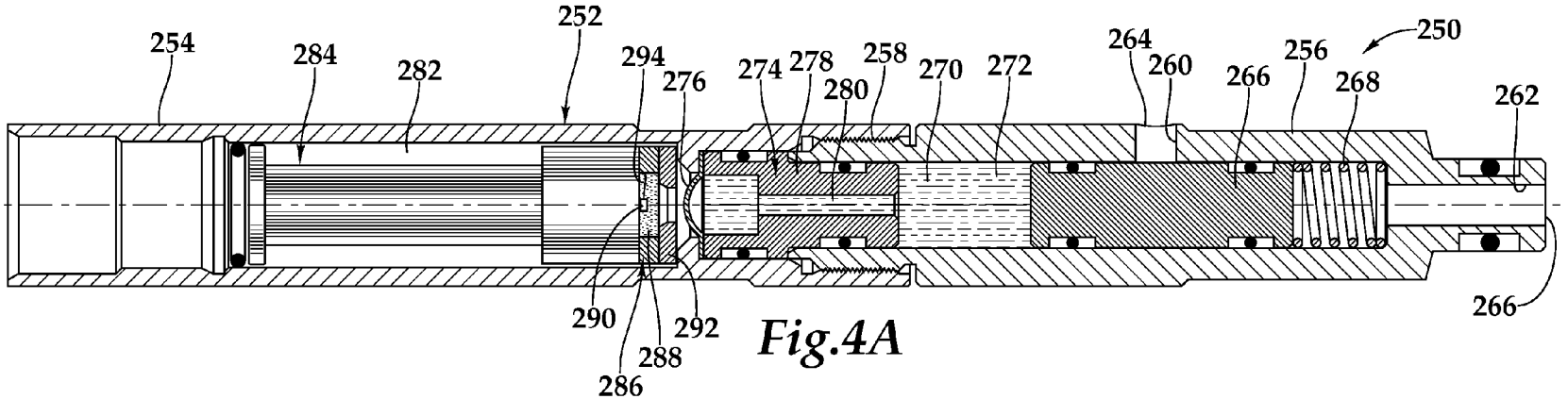
FIGS. 4A-4B are cross sectional views of a downhole actuator apparatus for controlling fluid communication between pressure regions in the well in first and second operating positions according to an embodiment of the present invention.
Figure 4B:
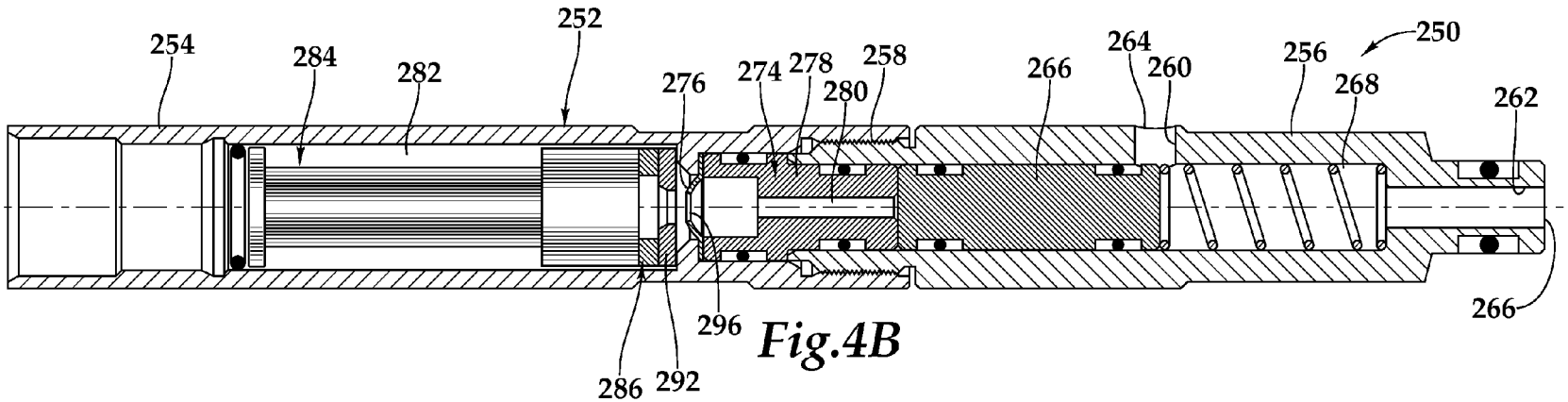

Referring now to FIGS. 4A-4B, a downhole actuator apparatus for controlling fluid communication between pressure regions in the well is depicted in first and second operating positions and is generally designated 250. Actuator 250 has an axially extending generally tubular body or housing assembly 252 including two housing members 254, 256 that are securably coupled together at a threaded coupling 258. Housing member 256 includes ports 260, 262 that are respectively in communication with different pressure regions 264, 266. Slidably and sealingly disposed within housing member 256 is a piston 266 that initially blocks communication between ports 260, 262, as best seen in FIG. 4A. Piston 266 is biased to the left by a biasing member depicted as a spiral wound compression spring 268, however, those skilled in the art will recognize that other types of biasing member, including other types of mechanical spring or fluid spring, could alternatively be used without departing from the principle of the present invention. Initially, displacement of piston 266 to the left is substantially prevented a fluid 270 disposed within a fluid chamber 272.

Securably and sealingly positioned between housing member 254 and housing member 256 is a barrier assembly 274 that includes a barrier 276 and a support assembly 278 having a fluid passageway 280 defined therethrough. Barrier 276 initially prevents fluid 270 from escaping from chamber 272 into a chamber 282 of housing member 254. Positioned within housing member 254 is a control system 284 that includes a signal detector, a control circuit, a power supply, optional timing devices and an output signal generator or trigger depicted in FIG. 4A as a chemical jet nozzle assembly 286. Chemical jet nozzle assembly 286 includes a chemical element or energetic material 288, an ignition agent 290 and a nozzle 292.

In operation, the signal detector of control system 284 receives the predetermined input signal and the control circuit processes the predetermined input signal to verify the signal. If the control circuit determines that actuator 250 should be operated, electrical power is supplied from the power supply to ignition agent 290 via electrical cable 294 to initiate the chemical reaction in chemical element 288. The chemical reaction causes barrier 276 to fail, as best seen in FIG. 4B. Fluid communication is thus established between chamber 272 and chamber 282 through opening 296, which allows fluid 270 to exit chamber 272 as piston 266 is urged to the left by spring 268. Communication is now permitted between pressure regions 264, 266 via ports 260, 262, as best seen in FIG. 4B.

Figure 5A:
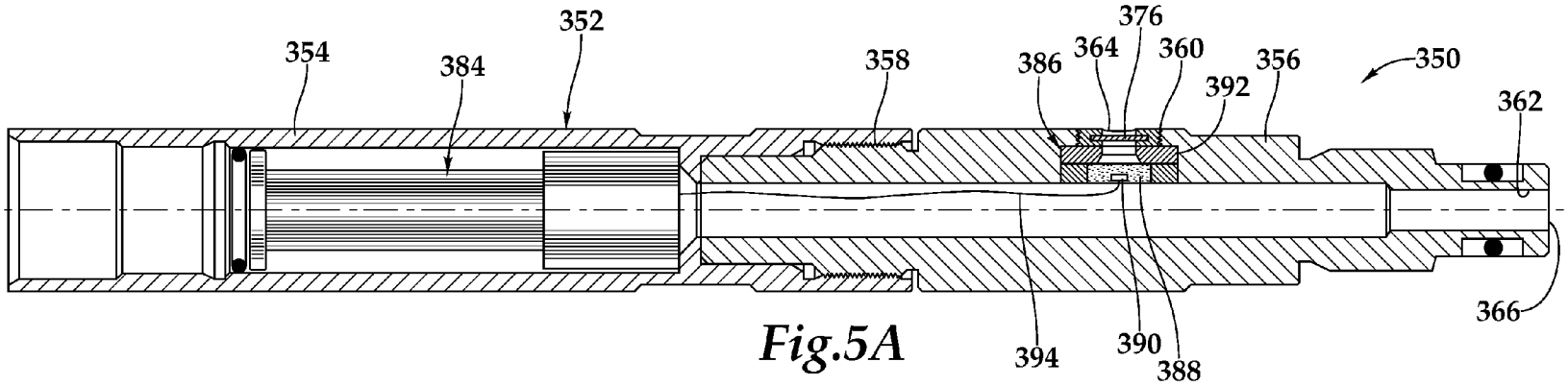
FIGS. 5A-5B are cross sectional views of a downhole actuator apparatus for controlling fluid communication between pressure regions in the well in first and second operating configurations according to an embodiment of the present invention.
Figure 5B:
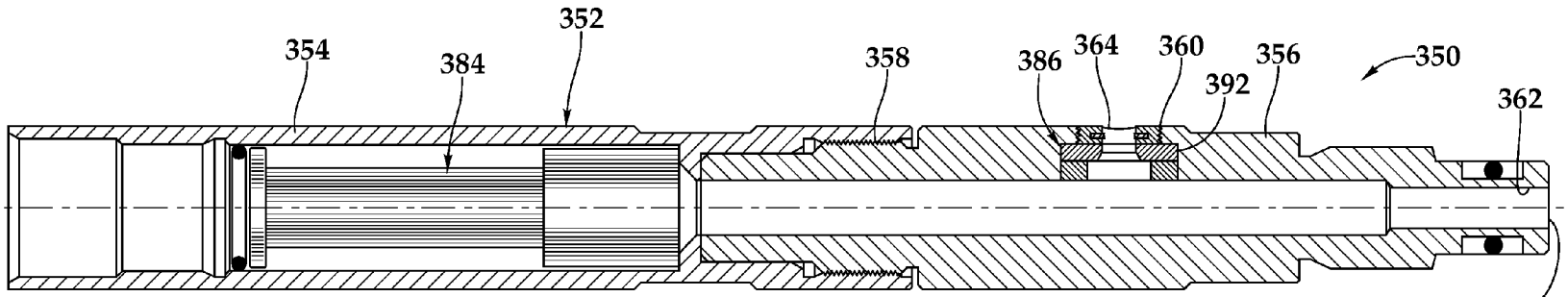

Referring now to FIGS. 5A-5B, a downhole actuator apparatus for controlling fluid communication between pressure regions in the well is depicted in first and second operating positions and is generally designated 350. Actuator 350 has an axially extending generally tubular body or housing assembly 352 including two housing members 354, 356 that are securably coupled together at a threaded coupling 358. Housing member 356 includes ports 360, 362 that are respectively in communication with different pressure regions 364, 366. Positioned within port 360 is a barrier 376 that is operable to initially prevent fluid communication between pressure regions 364, 366. Positioned within housing assembly 352 is a control system 384 that includes a signal detector, a control circuit, a power supply, optional timing devices and an output signal generator or trigger depicted in FIG. 4A as a chemical jet nozzle assembly 386. Chemical jet nozzle assembly 386 includes a chemical element or energetic material 388, an ignition agent 390 and a nozzle 392.

In operation, the signal detector of control system 384 receives the predetermined input signal and the control circuit processes the predetermined input signal to verify the signal. If the control circuit determines that actuator 350 should be operated, electrical power is supplied from the power supply to ignition agent 390 via electrical cable 394 to initiate the chemical reaction in chemical element 388. The chemical reaction causes barrier 376 to fail, as best seen in FIG. 5B. Communication is now permitted between pressure regions 364, 366 via ports 360, 362, as best seen in FIG. 5B.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A downhole actuator apparatus comprising:

a body defining first and second chambers and a fluid path between first and second pressure regions;

a piston slidably disposed in the body and selectively moveable between first and second positions, in the first position, the piston blocking fluid communication between the first and second pressure regions and the first chamber and between the first pressure region and second pressure region, in the second position, the piston blocking fluid communication between the first and second pressure regions and the first chamber and allowing fluid communication between the first pressure region and second pressure region;

a barrier disposed in the body and selectively separating the first and second chambers;

a fluid disposed in the first chamber between the barrier and the piston; and a control system at least partially disposed within the body, the control system operable to generate an output signal responsive to receipt of a predetermined input signal, the output signal operable to create a failure of the barrier such that at least a portion of the fluid flows from the first chamber to the second chamber and the piston moves from the first position to the second position, thereby allowing fluid communication between the first and second pressure regions.

2. The apparatus as recited in claim 1 wherein the body defines a fluid path between two pressure regions and wherein the piston is sealably disposed in the fluid path to maintain a pressure differential between the two pressure regions when the piston is in the first position.

3. The apparatus as recited in claim 2 wherein the piston includes a piston area that is exposed to pressure from at least one of the pressure regions.

4. The apparatus as recited in claim 1 wherein the piston is biased toward the second position from the first position by a spring.

5. The apparatus as recited in claim 1 wherein the fluid prevents the piston from moving to the second position until failure of the barrier.

6. The apparatus as recited in claim 1 wherein the barrier further comprises a disc member.

7. The apparatus as recited in claim 1 wherein the fluid further comprises a substantially incompressible fluid.

8. The apparatus as recited in claim 1 wherein the fluid further comprises a compressible fluid.

9. The apparatus as recited in claim 1 wherein the control system further comprises a signal detector, control circuit and a trigger, wherein upon receipt of the predetermined input signal by the signal detector, the control circuit activates the trigger to create the failure of the barrier.

10. The apparatus as recited in claim 9 wherein the predetermined input signal further comprises a surface generated signal selected from the group consisting of a wireless signal, an electromagnetic signal, an acoustic signal, a pressure signal, an electrical signal and an optical signal.

11. The apparatus as recited in claim 9 wherein the predetermined input signal further comprises a downhole generated signal selected from the groups consisting of a timer generated signal and a sensor generated signal.

12. The apparatus as recited in claim 9 wherein the output signal further comprises heat generated by the trigger that melts at least a portion of the barrier.

13. The apparatus as recited in claim 9 wherein the output signal further comprises pressure generated by the trigger that shifts a piercing assembly that forms an opening through the barrier.

14. The apparatus as recited in claim 9 wherein the output signal further comprises a chemical jet generated by the trigger that makes an opening in the barrier.

15. The apparatus as recited in claim 9 wherein the trigger further comprises an energetic material selected from the group consisting of pyrotechnic compositions, flammable solids, explosives and thermites.

16. A downhole actuator apparatus comprising:

a body defining first and second chambers and a fluid path between first and second pressure regions;

a piston slidably disposed in the body and selectively moveable between first and second positions, in the first position, the piston blocking fluid communication between the first and second pressure regions and the first chamber and between the first pressure region and second pressure region, in the second position, the piston blocking fluid communication between the first and second pressure regions and the first chamber and allowing fluid communication between the first pressure region and second pressure region;

a barrier disposed in the body and selectively separating the first and second chambers;

a fluid disposed in the first chamber between the barrier and the piston, the fluid operable to selectively retain the piston in the first position; and a control system at least partially disposed within the body, the control system including a signal detector, a control circuit and a trigger, wherein upon receipt of a predetermined input signal by the signal detector, the control circuit activates the trigger to create a failure of the barrier such that at least a portion of the fluid flows from the first chamber to the second chamber and the piston moves from the first position to the second position, thereby allowing fluid communication between the two pressure regions.

17. The apparatus as recited in claim 16 wherein the barrier further comprises a disc member.

18. The apparatus as recited in claim 16 wherein the trigger further comprises a thermite trigger that melts at least a portion of the barrier.

19. The apparatus as recited in claim 16 wherein the trigger further comprises a thermite trigger that propels a mechanical piercing assembly into the barrier.

20. The apparatus as recited in claim 16 wherein the trigger further comprises a thermite trigger that discharges a chemical jet that makes an opening in the barrier.

* * * * *